US005996565A

United States Patent [19]

Whitmer

[11] Patent Number: 5,996,565

[45] Date of Patent: Dec. 7, 1999

[54] BALL THROWING APPARATUS KIT

[76] Inventor: Joseph W. Whitmer, 13106 Loguna, Houston, Tex. 77015

[21] Appl. No.: 09/135,445

[22] Filed: Aug. 17, 1998

[51] Int. Cl.[6] ..... A63B 65/12

[52] U.S. Cl. ..... 124/17

[58] Field of Search ..... 124/16, 17, 20.1

[56] References Cited

U.S. PATENT DOCUMENTS

| | | | |
|---|---|---|---|
| 1,182,024 | 5/1916 | MacLeod et al. | 124/7 |
| 3,277,878 | 10/1966 | Pankratz | 124/20.1 |
| 3,552,371 | 1/1971 | Kahelin | 124/7 |
| 3,802,409 | 4/1974 | Mike et al. | 124/20.1 |
| 4,240,396 | 12/1980 | Randoll | 124/17 |
| 4,873,964 | 10/1989 | Bonoan | 124/20.1 |
| 5,249,564 | 10/1993 | Peachey | 124/17 |
| 5,431,145 | 7/1995 | Strait et al. | 124/17 |
| 5,657,984 | 8/1997 | Leo | 124/20.1 |

*Primary Examiner*—John A. Ricci

[57] ABSTRACT

A kit for assembly into an apparatus for throwing a whiffle ball comprising an elastic catapult for attachment to vertical posts and a calibrated speed strap for aligning the throw and estimating the speed of the ball. The catapult comprises a pouch with surgical tubing for propulsion and straps with hook and loop tape for affixing the catapult to the vertical posts.

10 Claims, 4 Drawing Sheets

BALL THROWING APPARATUS KIT

BACKGROUND OF THE INVENTION

1. Field of the Invention

The present invention relates to an apparatus for throwing a ball for a batter to attempt to hit with a bat. More particularly the apparatus throws a light hollow plastic ball having holes in the surface known as a whiffle ball.

2. Related Art

Baseball throwing machines are prolific in the art and are generally complicated mechanical contrivances having many parts and requiring considerable skill to operate. Patents on baseball throwing or pitching machines date from at least as early as 1915 to as late as 1997. Illustrative of these pitching machines are U.S. Pat. Nos. 1,152,186; 1,162,910; 1,182,024; 1,777,976; 2,080,958; 2,082,818; 2,192,096; 2,834,331; 3,254,639; 3,261,341; 3,277,878; 3,368,541; 3,406,674; 3,480,859; 3,552,371; 3,722,494; 4,111,179; 4,269,162; 4,391,264; 4,409,953; 4,524,749; 4,784,107; 4,860, 717; 4,955,606; 5,121,735; 5,413,085; 5,437,261; 5,439,212; and 5,660,386.

By definition "whiffle" means "to emit or produce a light whistling or puffing sound". See *Merriam Webster's Collegiate Dictionary Tenth Edition*, published by Merriam Webster, Inc. A whiffle ball is a light hollow plastic ball having generally uniform round holes on the surface. The lightness and holes produce movement as the ball moves through the air, the movement generally being exaggerated over that of a solid ball such as a baseball. None of the art cited above is adapted to throw the whiffle ball. But because of its light weight its use is less dangerous to the hitter.

SUMMARY OF THE INVENTION

The present invention is for an inexpensive kit to provide an easy-to-operate ball throwing apparatus for use with a whiffle ball. The kit comprises a (1) catapult made up of a pouch attached to elastic arms which are adapted to secure to posts preferably mounted in the ground, (2) a speed strap or tape adapted to lay on the ground midway between the posts and pointed directly toward the home plate target. The tape is calibrated so that the speed of the ball may be adjusted by the amount of deflection of the elastic arms.

DETAILED DESCRIPTION OF THE INVENTION

For a detailed description of the preferred embodiment the reader is directed to the accompanying figures in which like components are given like numerals for ease of reference.

Figure 1:
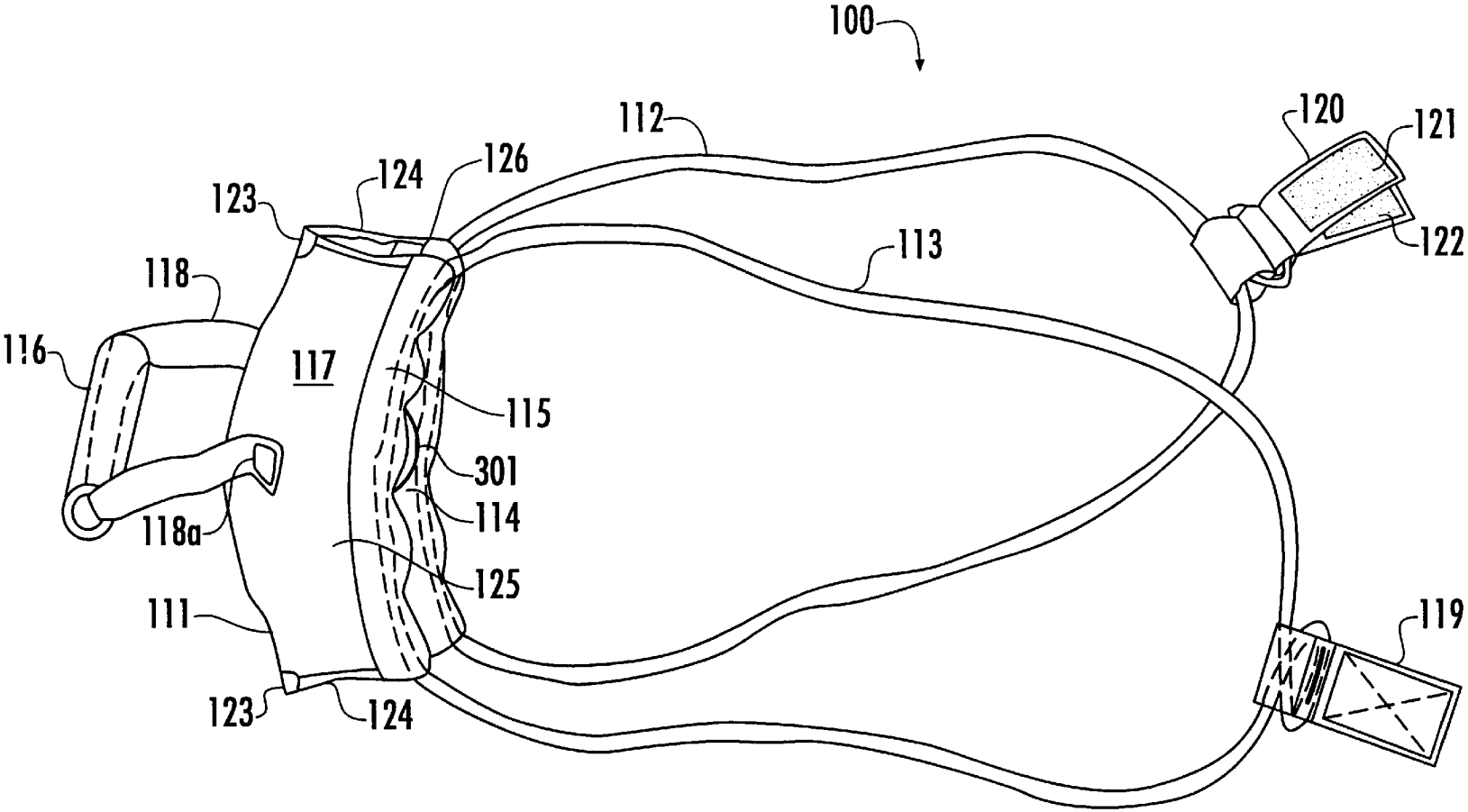
FIG. 1 is a isometric view of the catapult used in the present invention.

Referring first to FIG. 1 there is shown an isometric view of the catapult 100 used in the instant invention. The catapult 100 is seen to comprise a pocket 111 for holding the whiffle ball with elastic surgical tubing 112 and 113 secured along opposite edges 114 and 115. A handle 116 is secured to the back 117 of the pocket 111 by strap 118. At the extreme ends of each of the surgical tubings 112 and 113 are straps 119 and 120. The straps 119 and 120 have hook and loop tape such as VELCRO® on opposing 121 and 122 (shown on strap 120 only) for securing the strap in a circular fashion around vertical posts.

Figure 3:
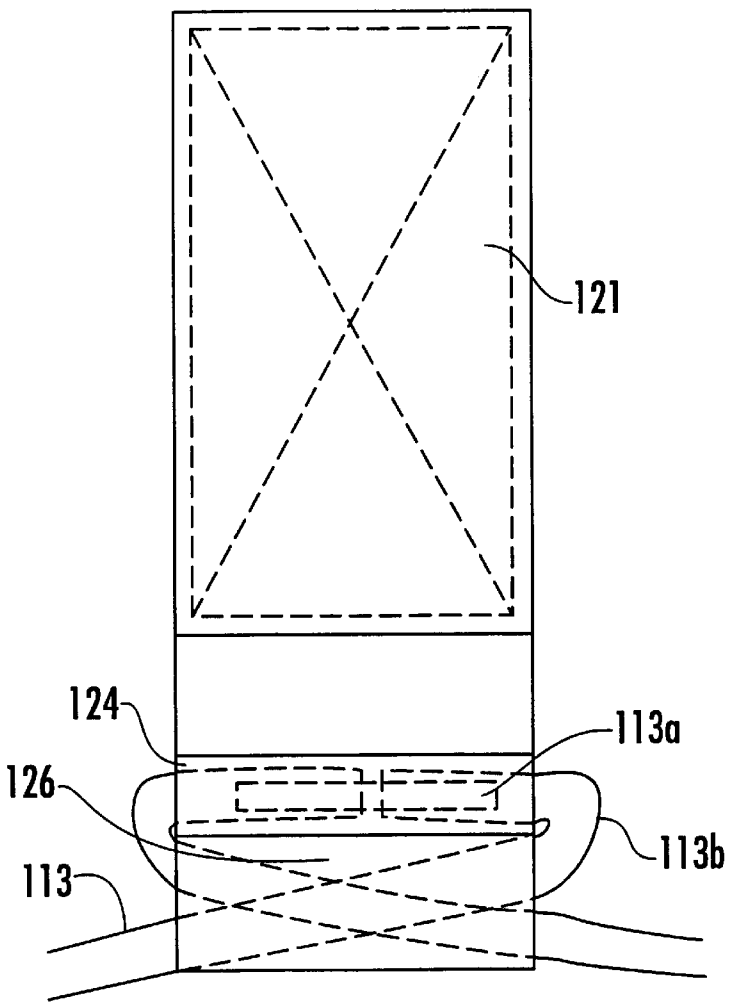
FIG. 3 is a top plan view of the detail of FIG. 2.
Figure 2:
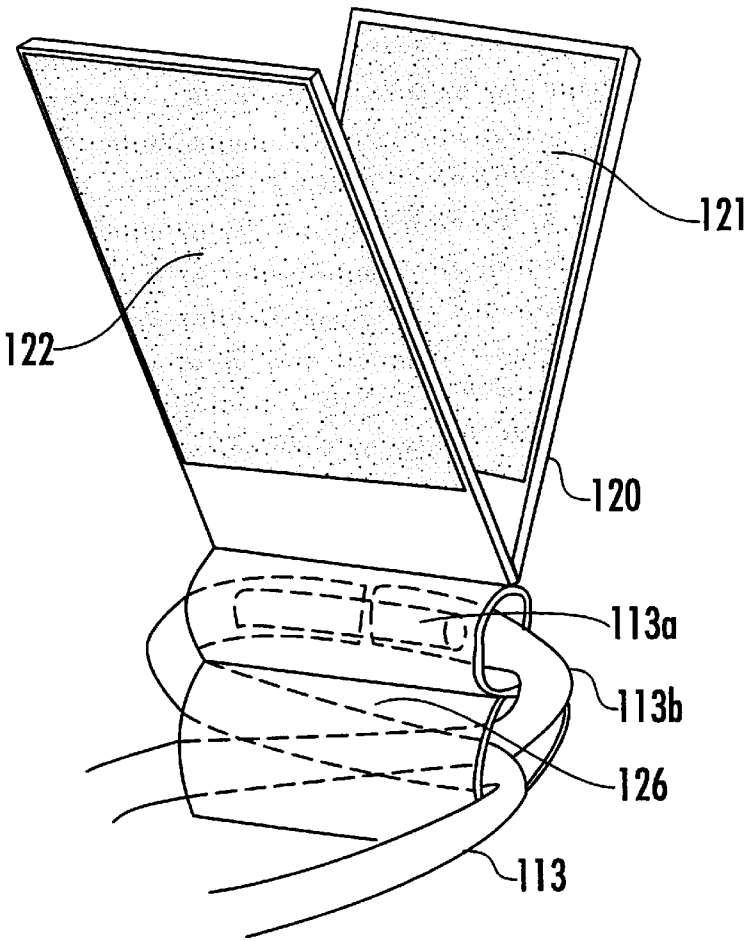
FIG. 2 is an isometric detail of the surgical tubing attachment to the catapult.

Referring now to FIG. 2 and FIG. 3 the details of the attachment of one of the straps 120 to one of the surgical tubing strips 113 is shown. The strap 113 is shown to have two open ended pockets 124 and 126 at one end formed by stitching. The tubing 113 having a solid cylindrical stiffener 113A is passed through pocket 124 with stiffener 113A positioned within the pocket. The tubing 113 is then twisted into a cross loop 113B which is secured within second pocket 126. This particular arrangement is effective for preventing the straps from moving along the length of the tubing.

Figure 4:
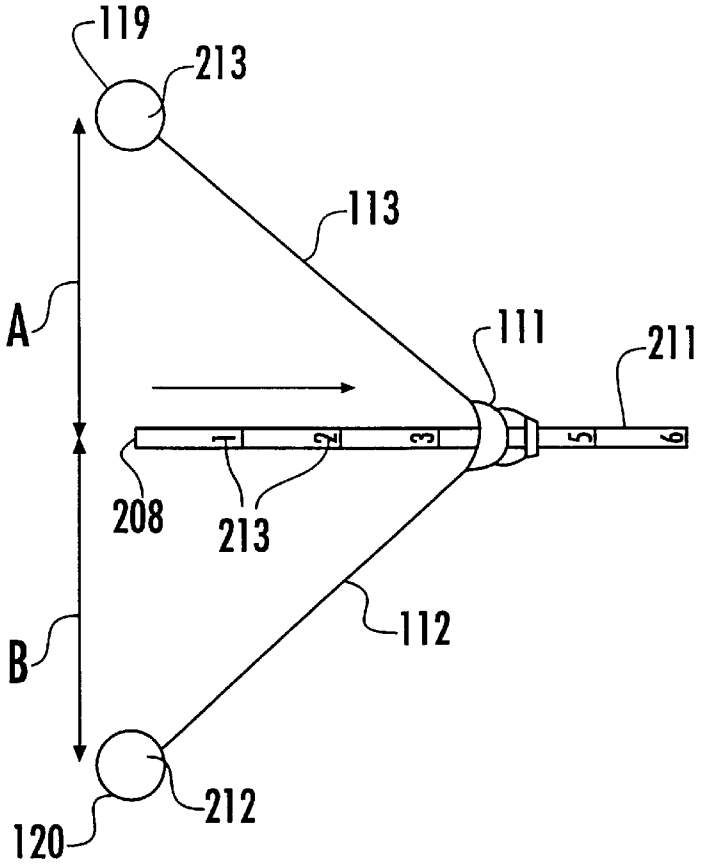
FIG. 4 is a view of the placement of the catapult and speed strap on the ground.

Referring now to FIG. 4 an overhead view of the placement of the catapult and calibrated speed strap is shown. A position 208, preferably 30 feet from the target 210, is selected and the speed strap 211 secured on the ground stretching back and pointing directly toward the target. The speed strap can be conveniently secured to the ground using three inch nails. Two vertical posts 212 and 213 are secured in the ground two feet six inches (indicated by lines A and B) from the position 208 and on a line perpendicular to the speed strap 211. The straps 119 and 120 are secured about the posts 212 and 213 respectively about waist high using the VELCRO. To prevent the straps 119 and 120 from slipping downward on the posts electrical tape (not shown) may be wound about the posts below the straps 119 and 120.

The speed strap 211 preferably has markings or other indicia 213 to provide a calibration on at least one surface thereof which are used in cooperation with the pocket and straps to adjust the velocity of a ball by the tension placed on the straps by the distance the pocket is withdrawn from line A—B as determined by the location of the pocket relative to the indicia.

Figure 5:
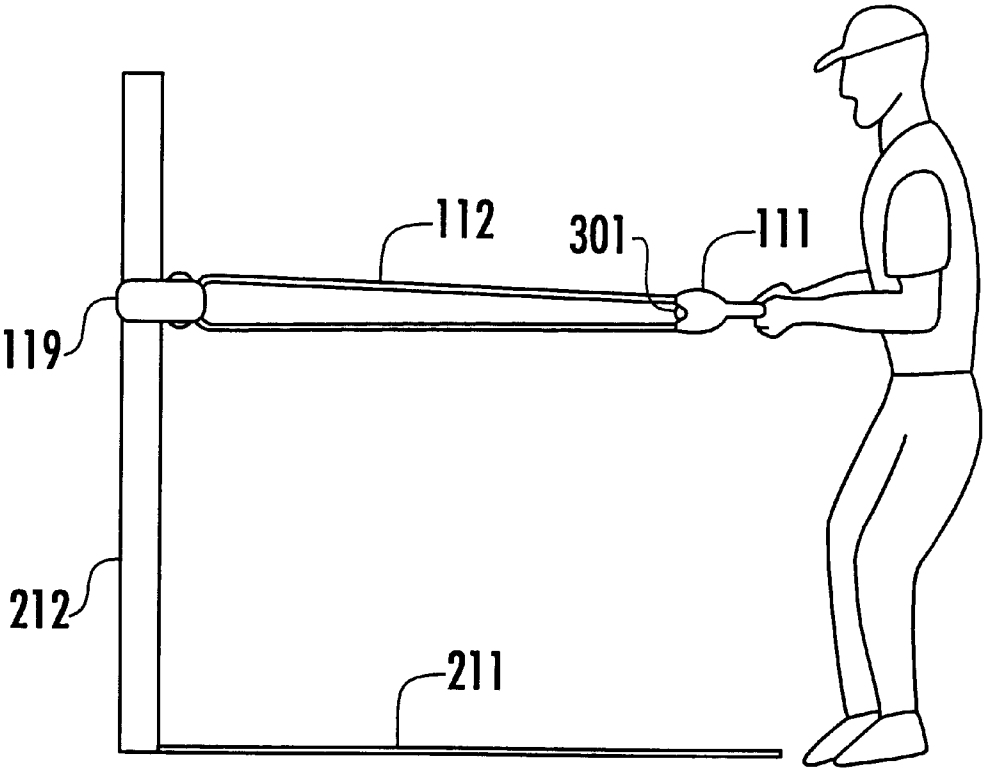
FIG. 5 is a view of the use of the invention.

Referring now to FIG. 5 a side elevational view of the apparatus in use is shown. A whiffle ball 301 is placed in pocket 111 and the pocket pulled backward away from the target (home plate) 210 to stretch the tubing 112 until the pocket is aligned with the desired calibration on the speed strap. The pocket 111 is held about waist or belt buckle high and at a signal from the batter is released. The direction of the ball may be adjusted using the speed strap as a guide. If the ball tends to fall out of the pocket before release it can be held in place by the first two fingers of one hand until the release. In a preferred embodiment a crimp 123 is place on each edge 125 and 126 by tacks or darts about midway between the sides 114 and 115, such that when the straps 112 and 113 are tensioned the flaps 125 and 126 tend to curve towards each other forming a narrowing opening between the sides and forming a pouch which grips a ball so that it will not leave the pouch until the tension on the straps is released and the pocket is pulled forward and the ball expelled from the pocket at a predetermined velocity by the momentum of the pocket as it is stopped in its forward trajectory by the straps.

The invention claimed is:

1. A kit for a ball throwing apparatus comprising:

(a) a catapult comprising:

(i) a pocket for containing a whiffle ball, said pocket having a pair of sides, a pouch and a back, (ii) a pair of elastic propulsion arms secured along opposite sides of said pocket, each of said arms being adaptable to attach to an upright post structure and comprising surgical tubing secured to the edges of said pocket, (iii) a handle secured to the back of said pocket and (iv) straps at the extreme ends of said surgical tubing to secure said arms to said posts; and (b) a speed strap for disposal between said arms when said arms are attached to vertical posts, said strap being disposed perpendicular to a straight line drawn between said posts and along the direction to a target.

2. The kit according to claim 1 further comprising hook and loop tape disposed on cooperative surfaces of said straps to secure said straps about said posts.

3. The kit according to claim 1 further comprising at least one whiffle ball.

4. A catapult comprising:

(i) a pocket for containing a whiffle ball, said pocket having a pair of sides, a pouch and a back, (ii) a pair of elastic propulsion arms secured along opposite sides of said pocket, each of said arms being adaptable to attach to an upright post structure, (iii) straps at the extreme ends of said surgical tubing to secure said arms to said posts and (iv) a handle secured to the back of said pocket.

5. The catapult according to claim 4 wherein each of said arms comprises surgical tubing secured to the edges of said pocket.

6. The catapult according to claim 4 further comprising hook and loop tape disposed on cooperative surfaces of said straps to secure said straps about said posts.

7. A ball throwing apparatus comprising (a) a catapult comprising:

(i) a pocket for containing a whiffle ball said pocket having sides, a pouch and a back, (ii) a pair of elastic propulsion arms secured along opposite sides of said pocket, each of said propulsion arms being attached to a pair of fixed spaced-apart upright posts, (iii) a handle secured to the back of said pocket and (iv) straps at the extreme ends of said surgical tubing to secure said arms to said posts; and (b) a speed strap disposed between said arms and perpendicular to a straight line through said posts.

8. The ball throwing apparatus according to claim 7 wherein each of said arms comprises surgical tubing secured to the edges of said pocket.

9. The ball throwing apparatus according to claim 7 further comprising hook and loop tape disposed on cooperative surfaces of said straps to secure said straps about said posts.

10. A ball throwing apparatus comprising (a) a catapult comprising:

(i) a pocket for containing a whiffle ball said pocket having sides, a pouch and a back, (ii) a pair of elastic propulsion arms secured along opposite sides of said pocket, each of said propulsion arms being attached to a pair of fixed spaced-apart upright posts, (iii) two opposed edges extending between said sides and a crimp on each edge of said pocket about equidistant between said sides and (iv) a handle secured to the back of said pocket; and (b) a speed strap disposed between said arms and perpendicular to a straight line through said posts.

* * * * *